US006211771B1

(12) United States Patent
Zhang et al.

(10) Patent No.: US 6,211,771 B1
(45) **Date of Patent: *Apr. 3, 2001**

(54) ELECTRICAL DEVICE

(76) Inventors: Michael Zhang, 34315 Eucalyptus Ter., Fremont, CA (US) 94555; Mark S. Thompson, 2049 Greenwood Dr.; James Toth, 107 Crestview Ct., both of San Carlos, CA (US) 94070; William Cardwell Beadling, 3170 Marten Ave., San Jose, CA (US) 95148

( * ) Notice: Subject to any disclaimer, the term of this patent is extended or adjusted under 35 U.S.C. 154(b) by 0 days.

This patent is subject to a terminal disclaimer.

(21) Appl. No.: 09/215,646

(22) Filed: Dec. 16, 1998

Related U.S. Application Data

(63) Continuation of application No. 08/808,135, filed on Feb. 28, 1997, now Pat. No. 5,864,281, which is a continuation of application No. 08/257,586, filed on Jun. 9, 1994, now abandoned.

(51) Int. Cl.[7] ..... H01C 7/10

(52) U.S. Cl. ..... 338/22 R; 338/203; 338/328; 338/13; 29/612; 29/610.1

(58) Field of Search ..... 338/21, 22 R, 338/22 SD, 203, 312, 313, 324, 331, 322, 13, 20, 314, 328; 29/610.1, 612, 620

(56) References Cited

U.S. PATENT DOCUMENTS

| | | | |
|---|---|---|---|
| 3,351,882 | 11/1967 | Kohler et al. | 338/322 |
| 3,497,859 | 2/1970 | Bang | 338/309 |
| 3,775,725 | 11/1973 | Endo | 338/262 |
| 3,835,434 | 9/1974 | Kahn | 338/22 R |
| 4,200,970 | 5/1980 | Schonberger | 29/593 |
| 4,371,860 | 2/1983 | May et al. | 338/21 |
| 4,434,416 | 2/1984 | Schonberger | 338/203 |
| 4,486,737 | 12/1984 | Ott | 338/22 R |

(List continued on next page.)

FOREIGN PATENT DOCUMENTS

| | | | |
|---|---|---|---|
| 31 22 612 | 12/1982 | (DE) | H01C/17/06 |
| 0 509 582 | 10/1992 | (EP) | H01C/7/00 |
| 56-150802 | 11/1981 | (JP) . | |
| 63-216301 | 9/1988 | (JP) | H01C/7/02 |
| WO 84/01259 | 3/1984 | (WO) | H02K/13/00 |
| WO 94/01876 | 1/1994 | (WO) | H01C/1/14 |
| WO 95/08176 | 3/1995 | (WO) | H01C/1/14 |

OTHER PUBLICATIONS

Search Report for International Application No. PCT/US95/07420, dated Sep. 4, 1995.

"PolySwitch SMD Surfaced Mount devices PTC overcurrent protection" trade brochure, Raychem Corporation, Nov. 1992.

*Primary Examiner*—Karl D. Easthom

(57) ABSTRACT

Electrical devices, particularly circuit protection devices, contain conductive polymer elements whose edges are formed by breaking the conductive polymer element, along a desired path, without the introduction of any solid body into the element. The resulting cohesive failure of the conductive polymer produces a distinctive fractured surface. One method of preparing such devices involves etching fracture channels in the electrodes of a plaque containing a PTC conductive polymer element sandwiched between metal foil electrodes, and then snapping the plaque along the fracture channels to form individual devices.

9 Claims, 4 Drawing Sheets

U.S. PATENT DOCUMENTS

| | | | |
|---|---|---|---|
| 4,486,738 | 12/1984 | Sadlo et al. | 338/320 |
| 4,706,060 | 11/1987 | May | 338/20 |
| 4,757,298 | 7/1988 | Nishikawa et al. | 338/308 |
| 4,786,888 | 11/1988 | Yoneda et al. | 338/22 R |
| 4,788,523 | 11/1988 | Robbins | 338/309 |
| 4,801,784 | 1/1989 | Jensen et al. | 338/22 R |
| 4,876,439 | 10/1989 | Nagahori | 338/22 R |
| 4,924,074 | 5/1990 | Fang et al. | 219/548 |
| 4,924,204 | 5/1990 | Uchida | 338/22 R |
| 4,924,205 | 5/1990 | Caporali et al. | 338/227 |
| 4,992,771 | 2/1991 | Caporali et al. | 338/22 R |
| 4,993,142 | 2/1991 | Burke et al. | 29/621 |
| 5,247,277 | 9/1993 | Fang et al. | 338/22 R |
| 5,280,263 | 1/1994 | Sugaya | 338/22 R |
| 5,303,115 | 4/1994 | Nayar et al. | 361/106 |
| 5,351,390 * | 10/1994 | Yamada et al. | 338/22 R |
| 5,831,510 | 11/1998 | Zhang et al. | 338/22 R |
| 5,852,397 | 12/1998 | Chan et al. . | |
| 5,864,281 * | 1/1999 | Zhang et al. | 338/22 R |

* cited by examiner

ELECTRICAL DEVICE

CROSS REFERENCE TO RELATED APPLICATIONS

This application is a continuation of application Ser. No. 08/808,135, filed Feb. 28, 1997, now U.S. Pat. No. 5,864,281, which is a file wrapper continuation of application Ser. No. 08/257,586, filed Jun. 9, 1994, now abandoned. This application is also related to commonly assigned U.S. application Ser. No. 08/121,717, filed Sep. 15, 1993, by Siden, Thompson, Zhang and Fang now abandoned, to commonly assigned U.S. application Ser. No. 07/910,950, now abandoned, filed Jul. 9, 1992, by Graves, Zhang, Chandler, Chan and Fang, now abandoned, and the corresponding PCT Application US93/06480, filed Jul. 8, 1993, and to the commonly assigned U.S. application Ser. No. 08/242,916 filed by Zhang and Fang on May 16, 1994, now abandoned in favor of continuation application Ser. No. 08/710,925, filed Sep. 24, 1996, now U.S. Pat. No. 5,831,510. The entire disclosure of each of those US and PCT applications is incorporated herein by reference for all purposes.

BACKGROUND OF THE INVENTION

1. Field of the Invention

This invention relates to devices comprising conductive polymer elements, in particular electrical devices such as circuit protection devices in which current flows between two electrodes through a conductive polymer element.

2. Introduction to the Invention

It is well known to make compositions which comprise a polymeric component and, dispersed therein, electrically conductive particles. The type and concentration of the particles may be such that the composition is conductive under normal conditions, e.g. has a resistivity of less than $10^6$ ohm-cm at 23° C., or is essentially insulating under normal conditions, e.g. has a resistivity of at least $10^9$ ohm-cm at 23° C., but has a non linear, voltage-dependent resistivity such that the composition becomes conductive if subjected to a sufficiently high voltage stress. The term "conductive polymer" is used herein to describe all such compositions. When the polymeric component comprises a crystalline polymer, the composition will usually exhibit a sharp increase in resistivity over a relatively narrow temperature range just below the crystalline melting point of the polymer, and such compositions are described as PTC compositions, the abbreviation "PTC" meaning positive temperature coefficient. The size of the increase in resistivity is important in many uses of PTC compositions, and is often referred to as the "autotherm height" of the composition. PTC conductive polymers are particularly useful in circuit protection devices and self-regulating heaters. Conductive polymers can contain one or more polymers, one or more conductive fillers, and optionally one or more other ingredients such as inert fillers, stabilizers, and anti-tracking agents. Particularly useful results have been obtained through the use of carbon black as a conductive filler.

For details of known or proposed conductive polymers and devices containing them, reference may be made, for example, to the documents incorporated herein by reference in the Detailed Description of the Invention below.

When a melt-processed, sintered, or otherwise shaped conductive polymer element is to be divided into smaller pieces, this has in the past been achieved by shearing (also referred to as "dicing") the conductive polymer element. For example, many circuit protection devices are made by shearing a laminate comprising two metal foils and a laminar PTC conductive polymer element sandwiched between the foils.

SUMMARY OF THE INVENTION

We have discovered that in many cases, important advantages can be obtained by dividing a conductive polymer mass into a plurality of parts by a process in which at least part of the division is effected by causing the conductive polymer element to break, along a desired path, without the introduction of any solid body into the conductive polymer element along that path. The resulting cohesive failure of the conductive polymer produces a surface (referred to herein as a "fractured" surface) which is distinctly different from that produced by a shearing process, which necessarily results in deformation of the conductive polymer by the cutting body. In order to control the path along which the conductive polymer element breaks, we prefer to provide one or more discontinuities which are present in one or more members secured to the conductive polymer, and/or in the conductive polymer itself, and whose presence causes the conductive polymer to fracture along desired paths which are related to the discontinuities.

The invention preferably makes use of assemblies in which a conductive polymer element is sandwiched between metal members having corresponding physical discontinuities in the form of channels. When such an assembly is bent in the regions of the channels, the conductive polymer element will fracture along paths which run between the corresponding channels in the metal members. However, the invention includes the use of other types of physical discontinuity and other kinds of discontinuity which will interact with a physical or other force to cause fracture of the conductive polymer along a desired path.

We have found the present invention to be particularly useful for the production of devices from a laminar assembly comprising a laminar PTC conductive polymer element sandwiched between metal foils. We have found that, such devices, especially when they are small (e.g. have an area of less than 0.05 $inch^2$), have a slightly higher resistance and a substantially higher autotherm height than similar devices produced by the conventional shearing process. The invention is particularly useful for the production of devices of the kind described in Ser. Nos. 08/121,717 and 08/242,916.

In one preferred aspect, the present invention provides a device comprising an element which (a) is composed of a composition which comprises (i) a polymeric component and (ii), dispersed in the polymer, electrically conductive particles, and (b) has at least one fractured surface.

A preferred embodiment of this aspect of this invention is a device which comprises (1) a laminar conductive polymer element which (a) is composed of a composition which comprises (i) the polymeric component and (ii) the electrically conductive particles in an amount such that the composition has a resistivity at 23° C. of less than $10^6$ ohm-cm, and (b) has a first principal face, a second principal face parallel to the first face, and at least one transverse face which runs between the first and second faces and at least a part of which has a fractured surface;

(2) a first laminar electrode which has (i) an inner face which contacts the first principal face of the conductive polymer element, and (ii) an outer face; and (3) a second laminar electrode which has (i) an inner face which contacts the second principal face of the conductive polymer element, and (ii) an outer face.

In another preferred aspect, the present invention provides a method of making a device, which method comprises (1) making an assembly which (a) comprises an element composed of a composition comprising (i) a polymeric component, and (ii), dispersed in the polymeric component, electrically conductive particles, and (b) has one or more discontinuities in or adjacent to the conductive polymer element; and (2) separating the assembly into two or more parts by a treatment which causes cohesive failure of the conductive polymer element along a path which is related to the discontinuity.

A preferred embodiment of this aspect of the invention is a method wherein the assembly comprises (A) a laminar conductive polymer element which
  (a) is composed of a composition which comprises a polymeric component and, dispersed in the polymeric component, electrically conductive particles in an amount such that the composition has a resistivity at 23° C. of less than $10^6$ ohm-cm, and
  (b) has a first principal face and a second principal face parallel to the first face, (B) a plurality of upper laminar conductive members, each of which has (a) an inner face which contacts the first principal face of the conductive polymer element and (b) an outer face, the upper conductive members defining, with intermediate portions of the conductive polymer element, a plurality of upper fracture channels, and (C) a plurality of lower laminar conductive members, each of which has (a) an inner face which contacts the second principal face of the conductive polymer element, and (b) an outer face, the lower conductive members defining, with intermediate portions of the conductive polymer element, a plurality of lower fracture channels; and wherein step (2) of the process comprises applying physical forces to the assembly which cause the conductive polymer element to fracture along a plurality of paths each of which runs between one of the upper fracture channels and one of the lower fracture channels.

In another preferred aspect, this invention provides an assembly which can be divided into a plurality of devices by method of the invention, and which comprises (A) a laminar conductive polymer element which
  (a) is composed of a composition which comprises a polymeric component and, dispersed in the polymeric component, electrically conductive particles, and
  (b) has a first principal face and a second principal face parallel to the first face, (B) a plurality of upper laminar conductive members, each of which has (a) an inner face which contacts the first principal face of the conductive polymer element and (b) an outer face, the upper conductive members defining, with intermediate portions of the conductive polymer element, a plurality of upper fracture channels, and (C) a plurality of lower laminar conductive members, each of which has (a) an inner face which contacts the second principal face of the conductive polymer element, and (b) an outer face, the lower conductive members defining, with intermediate portions of the conductive polymer element, a plurality of lower fracture channels.

A BRIEF DESCRIPTION OF THE DRAWING

The invention is illustrated in the accompanying drawing, in which

DETAILED DESCRIPTION OF THE INVENTION

Figure 1:
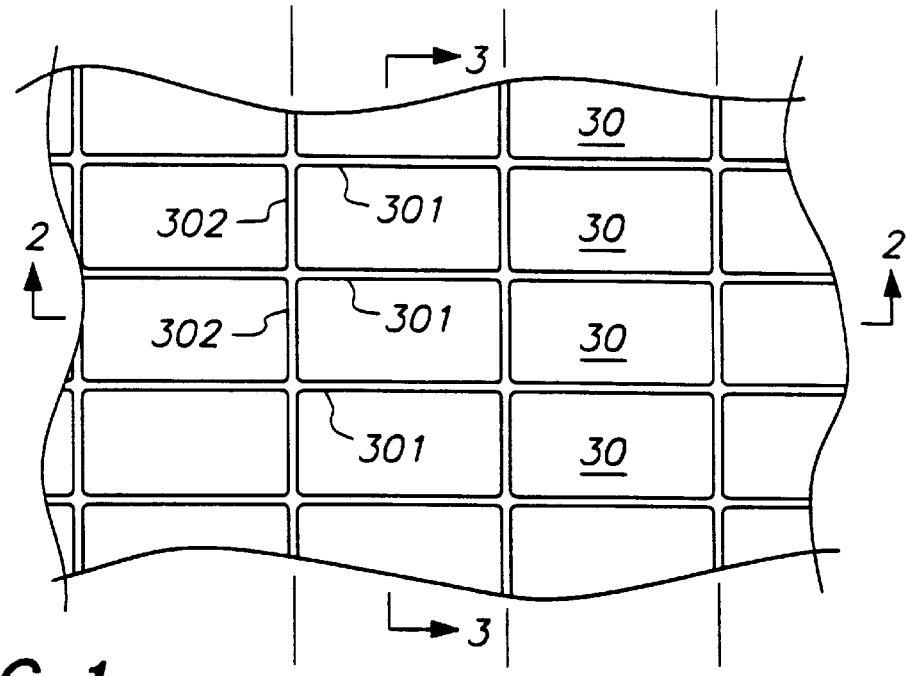
FIG. 1 is a diagrammatic plan view.

The invention is described below chiefly by reference to PTC circuit protection devices which comprise a laminar PTC element composed of a PTC conductive polymer and two laminar electrodes secured directly to the PTC element, and to methods for producing such devices in which a laminar element having surface discontinuities is subjected to physical forces which bend the element so as to cause cohesive failure of the conductive polymer. It is to be understood, however, that the description is also applicable, insofar as the context permits, to other electrical devices containing conductive polymer elements and to other methods.

As described and claimed below, and as illustrated in the accompanying drawings, and as further described and illustrated in the documents incorporated herein by reference, the present invention can make use of a number of particular features. Where such a feature is disclosed in a particular context or as part of a particular combination, it can also be used in other contexts and in other combinations, including for example other combinations of two or more such features.

Conductive Polymers

Any conductive polymer can be used in this invention, providing it is present in the form of an element which can be subjected to physical and/or other forces which will cause the element to undergo the cohesive failure which results in a fractured surface. The more brittle the conductive polymer, the easier it is to obtain this result. We have obtained excellent results using conductive polymers containing high proportions of carbon black, e.g. at least 40% by weight of the composition. When the conductive polymer will not snap easily, a variety of expedients can be used to assist in achieving the desired result. For example, the composition can be reformulated to include ingredients which render it more brittle, or it can be shaped into the element in a different way. The lower the temperature, the more brittle the conductive polymer, and in some cases it may be desirable to chill the conductive polymer element to a temperature below ambient temperature before breaking it, e.g. by passing it through liquid nitrogen. Compositions in which the polymeric component consists essentially of one or more crystalline polymers can usually be fractured without difficulty at temperatures substantially below the crystalline melting point. If the polymeric component consists of, or contains substantial amounts of, an amorphous polymer, the element is preferably snapped at a temperature below the glass transition point of the amorphous polymer. Crosslinking of the conductive polymer can make it more or less brittle, depending upon the nature of the polymeric component, the type of crosslinking process, and the extent of the crosslinking. The quantity of carbon black, or other conductive filler, in the conductive polymer must be such that the composition has the required resistivity for the particular device. The resistivity is, in general, as low as possible for circuit protection devices, e.g. below 10 ohm-cm, preferably below 5 ohm-cm, particularly below 2 ohm-cm, and substantially higher for heaters, e.g. $10^2$–$10^8$, preferably $10^3$–$10^6$ ohm-cm.

Suitable conductive polymer compositions are disclosed in U.S. Pat. Nos. 4,237,441 (van Konynenburg et al), 4,388,607 (Toy et al), 4,470,898 (Penneck et al), 4,534,889 (van Konynenburg et al), 4,545,926 (Fouts et al), 4,560,498 (Horsma et al), 4,591,700 (Sopory), 4,724,417 (Au et al), 4,774,024 (Deep et al), 4,775,778 (van Konynenburg et al), 4,859,836 (Lunk et al), 4,934,156 (van Konynenburg et al), 5,049,850 (Evans et al), 5,178,797 (Evans et al), 5,250,226 (Oswal et al), and 5,250,228 (Baigrie et al), and in pending U.S. application Nos. 07/894,119 (Chandler et al, filed Jun. 5, 1992), now U.S. Pat. No. 5,378,407, 08/085,859 (Chu et al, filed Jun. 29, 1993), now U.S. Pat. No. 5,451,919, 08/173,444 (Chandler et al, filed Dec. 23, 1994), now abandoned and 08/255,497 (Chu et al, filed Jun. 8, 1994, now U.S. Pat. No. 5,582,770. The disclosure of each of these patents and applications is incorporated herein by reference.

Conductive Polymer Elements

The conductive polymer is preferably present in the form of a laminar element having two principal faces which are parallel to each other and to which metal members are preferably attached. In many cases, the metal members are metal foils. Particularly suitable metal foils are disclosed in U.S. Pat. Nos. 4,689,475 (Matthiesen) and 4,800,253 (Kleiner et al), and in copending commonly assigned U.S. application No. 08/255,584 (Chandler et al, filed Jun. 8, 1994, now abandoned in favor of continuation application Ser. No. 08/672,496, filed Jun. 28, 1996, which is now abandoned in favor of continuation application Ser. No. 08/816,471, filed Mar. 13, 1997, the disclosure of each of which is incorporated herein by reference. The laminar conductive polymer element can be of any thickness which can be snapped, but is preferably less than 0.25 inch, particularly less than 0.1 inch, especially less than 0.05 inch, thick.

Discontinuities

The discontinuities which are present in the assemblies of the invention are preferably present in members which are secured to the principal faces of the conductive polymer element, so that, in the devices prepared from the assembly, the transverse faces of the conductive polymer element consist essentially of fractured surfaces. Preferably the discontinuities are continuous channels produced by etching a metal member so that it is separated into distinct segments, with the conductive polymer exposed at the bottom of the channel. However, the invention includes the use of discontinuities which are entirely within or formed in a surface of the conductive polymer, or which extend from members secured to the conductive polymer element into the conductive polymer element, for example channels routed through a metal member and partially into a conductive polymer element to which it is attached. In such cases, the transverse face will be partially sheared and partially fractured.

When there is a metal member secured to only one of the principal faces of the conductive polymer element, there need be discontinuities on one side only of the assembly. When there are metal members secured to both principal faces, discontinuities are needed in each metal member, positioned so that the conductive polymer will fracture along a path between the discontinuities. The discontinuities can be directly opposite to each other, so that the transverse fractured face meets the principal faces at a right angle, or offset from each other so that the transverse fractured face meets one of the principal faces at an angle less than 90°, e.g. 30° to 90°, preferably 45° to 90°, particularly 60° to 90°, and the other principal face at the complementary angle which is greater than 90°, e.g. 90° to 150°. The increased path length will influence the electrical properties of the device.

Devices

The invention can be used to make a wide variety of devices, but is particularly useful for making small devices, in which the edge properties of the conductive polymer element play a more important part than in large devices. The invention is especially useful for making circuit protection devices, e.g. those disclosed in U.S. Pat. Nos. 4,238,812 (Middleman et al), 4,255,798 (Simon), 4,272,471 (Walker), 4,315,237 (Middleman et al), 4,317,027 (Middleman et al), 4,329,726 (Middleman et al), 4,330,703 (Horsma et al), 4,426,633 (Taylor), 4,475,138 (Middleman et al), 4,472,417 (Au et al), 4,689,475 (Matthiesen), 4,780,598 (Fahey et al), 4,800,253 (Kleiner et al), 4,845,838 (Jacobs et al), 4,857,880 (Au et al), 4,907,340 (Fang et al), 4,924,074 (Fang et al), 4,967,176 (Horsma et al), 5,064,997 (Fang et al), 5,089,688 (Fang et al), 5,089,801 (Chan et al), 5,148,005 (Fang et al), 5,166,658 (Fang et al), and in co-pending, commonly assigned U.S. application Nos. 07/837,527 (Chan et al, filed Feb. 18, 1992), abandoned in favor of continuation application Ser. No. 08/087,017, now U.S. Pat. No. 5,436,609, 07/910,950 (Graves et al, filed Jul. 9, 1992), now abandoned in favor of continuation application Ser. Nos. 08/152,070, filed Nov. 12, 1993, and 08/121,717 (Siden et al, filed Sep. 15, 1993), now abandoned, the subject matter of both of the Graves et al and Siden et al applications being incorporated in a continuation-in-part application No. 08/302,138, filed Sep. 7, 1994, abandoned in favor of continuation application No. 07/727,869, filed Oct. 8, 1996, abandoned in favor of continuation application No. 08/900,787, filed Jul. 25, 1997, now U.S. Pat. No. 5,852,397, and 08/242,916 (Zhang et al, filed May 13, 1994) abandoned in favor of continuation application No. 08/710,925, filed Sep. 24, 1996, now U.S. Pat. No. 5,831,510. The disclosure of each of these patents and applications incorporated herein by reference.

Other devices which can be made are heaters, particularly sheet heaters, including both heaters in which the current flows normal to the plane of the conductive polymer element and those in which it flows in the plane of the conductive polymer element. Examples of heaters are found in U.S. Pat. Nos. 4,761,541 (Batliwalla et al) and 4,882,466 (Friel), the disclosures of which are incorporated herein by reference.

The conductive polymer element in the devices of the invention can have a single, curved, transverse face, as for example when the device is circular or oval, or can have a plurality of faces, as for example when the device is triangular, square, rectangular, rhomboid, trapezoid, hexagonal, or T-shaped, all of which shapes have the advantage that they can be produced without waste through the use of appropriate patterns of discontinuities. Circular and oval shapes can also be obtained by the present invention, but the residues of the fracturing process are generally not useful.

When the conductive polymer element has different electrical properties in different directions in the plane of the element, it is often possible to obtain devices which have significantly different properties by changing the orientation of the discontinuities relative to those directions.

The invention is illustrated in the accompanying drawings, in which the size of the apertures and channels and the thicknesses of the components have been exaggerated in the interests of clarity.

Figure 2:
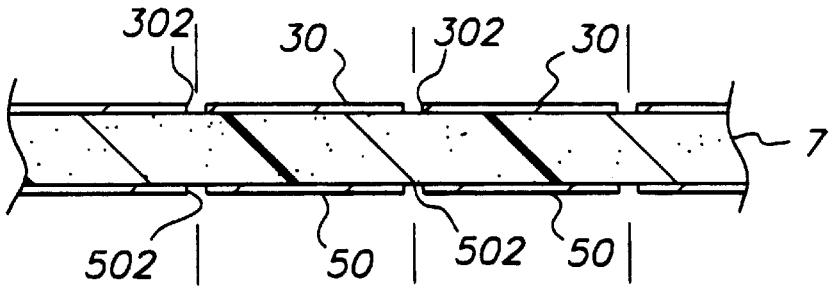
FIGS. 2 and 3 are diagrammatic partial cross-sections, at right angles to each other, of an assembly of the invention which can be converted into devices of the invention by the method of the invention.
Figure 3:
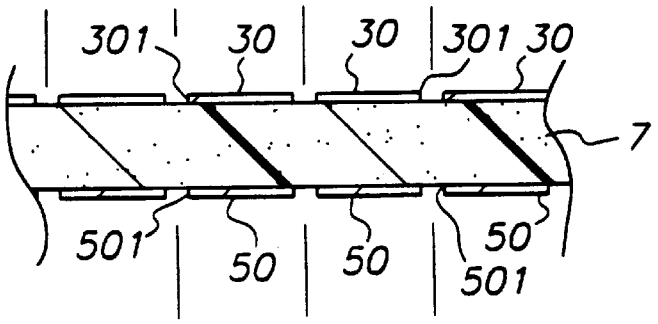

FIGS. 1–3 show an assembly which is ready to be divided into a plurality of devices by snapping it along the broken lines. The assembly contains a laminar PTC element 7 composed of a PTC conductive polymer and having a first principal face to which a plurality of upper metal foil members 30 are attached and a second principal face to which lower metal foil members 50 are attached. The upper members are separated from each other by upper fracture channels 301 running in one direction and upper fracture channels 302 at right angles thereto. The lower members are separated from each other by lower fracture channels 501 running in one direction and lower fracture channels 502 at right angles thereto.

Figure 4:
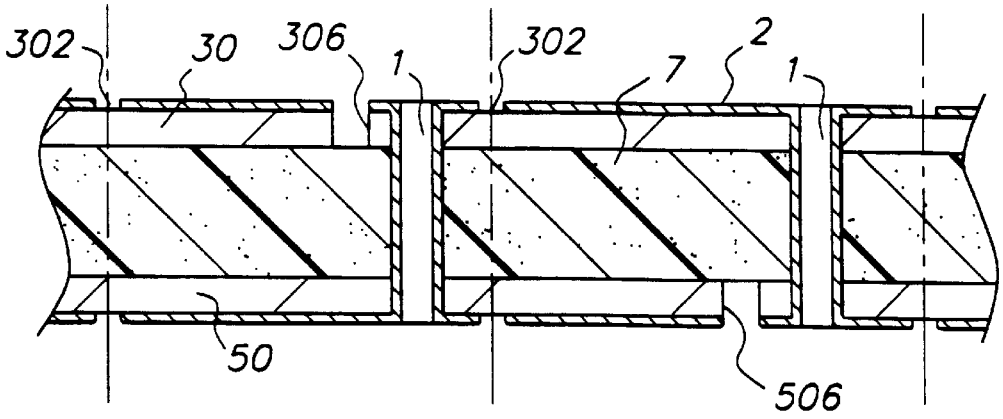
FIGS. 4–6 are diagrammatic partial cross-sections through assemblies of the invention in successive stages of a process for producing a device as described in Ser. No. 08/242,916 except that the edges thereof are fractured instead of sheared.
Figure 5:
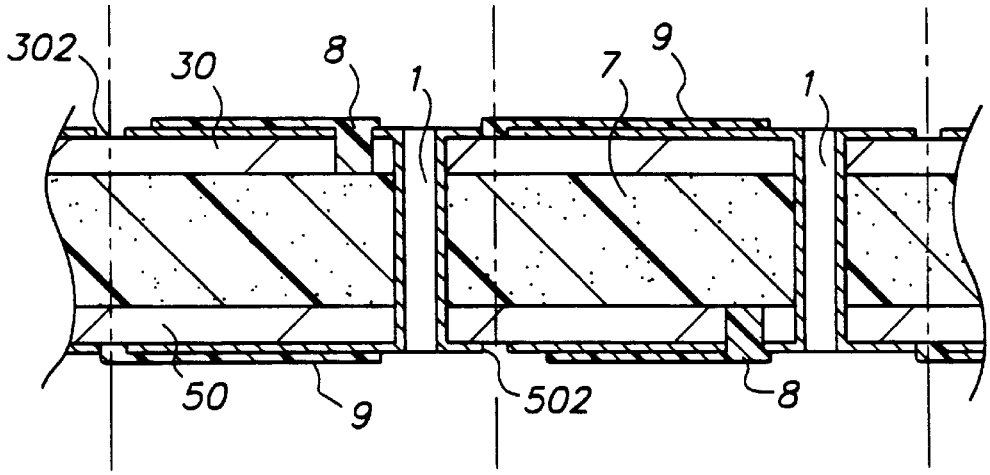
Figure 6:
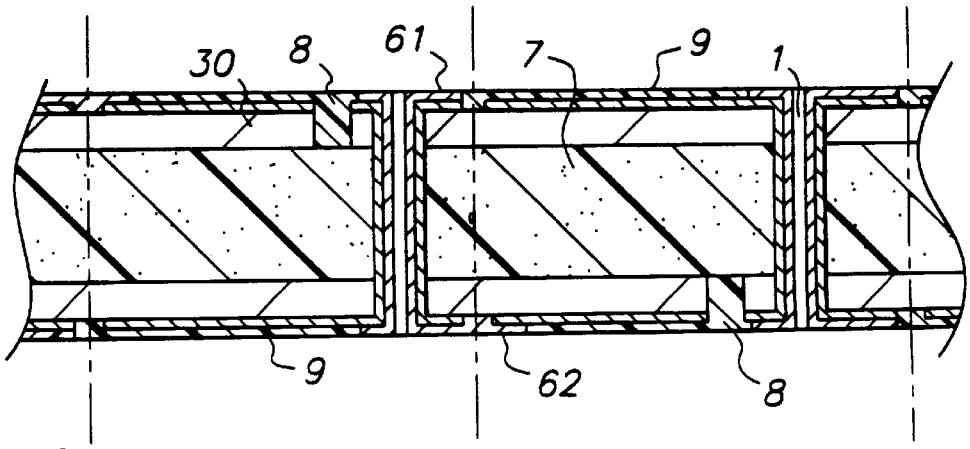

FIGS. 4 to 6 are diagrammatic partial cross-sections through a laminated plaque as it is converted into an assembly which can be divided into a plurality of individual devices of the invention by snapping it along the broken lines and along lines at right angles thereto (not shown in the Figures).

FIG. 4 shows an assembly containing a laminar PTC element 7 composed of a PTC conductive polymer and having a first principal face to which upper metal foil members 30 are attached and a second primary face to which lower metal foil members 50 are attached. A plurality of round apertures, arranged in a regular pattern, pass through the assembly. An electroplated metal forms cross-conductors 1 on the surfaces of the apertures and metal layers 2 on the outer faces of the members 30 and 50. The metal foil members are separated from each other by narrow fracture channels 301, 302, 501, 502 as in FIGS. 1–3 (only channels 302 and 502 being shown in the drawing) and by relatively wide channels 306 and 506 parallel to channels 302 and 502. FIG. 5 shows the assembly of FIG. 4 after the formation, by a photo-resist process, of (a) a plurality of parallel separation members 8 which fill the channels 306 and 506 and extend over part of the outer faces of the adjacent members 30 or 50 and (b) a plurality of parallel masking members 9 which fill some of the fracture channels and which are placed so that adjacent separation and masking members define, with the PTC element 7, a plurality of contact areas. FIG. 6 shows the assembly of FIG. 5 after electroplating it with a solder so as to form layers of solder 61 and 62 on the contact areas and also layers of solder on the cross-conductors and in the fracture channels not filled by the masking members. It will be seen that the contact areas are arranged so that when an individual device is prepared by dividing up the assembly, the solder layers overlap only in the vicinity of the cross-conductor, so that if any solder flows from top to bottom of the device, while the device is being installed, it will not contact the layer of solder on the second electrode.

Figure 7:
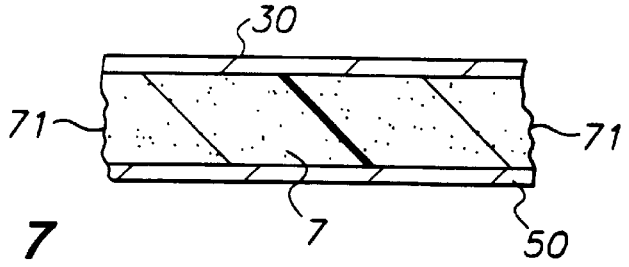
FIGS. 7–10 are diagrammatic cross-sections through devices of the invention.

FIG. 7 shows a device obtained by snapping the assembly of FIGS. 1–3 along the fracture channels. The device has four transverse faces 71 (two of which are shown in FIG. 7), each of which has a fractured surface.

Figure 8:
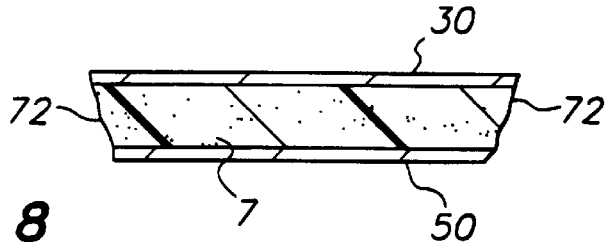

FIG. 8 shows a device similar to that in FIG. 7 but in which each of the transverse faces 72 meets one of the principal faces at an angle of less than 90° and the other principal face at an angle of more than 90°. Such a device can be made from an assembly as in FIGS. 1–3 except that the upper and lower fracture channels are offset from each other.

Figure 9:
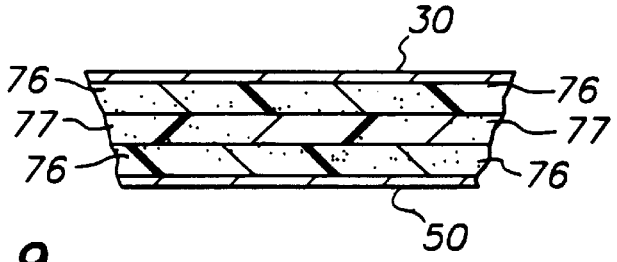

FIG. 9 shows a device similar to that in FIG. 8 except that the laminar PTC conductive polymer element has three layers, the outer layers 76 being composed of a PTC conductive polymer having one resistivity and the center layer 77 being composed of a PTC conductive polymer having a higher resistivity.

Figure 10:
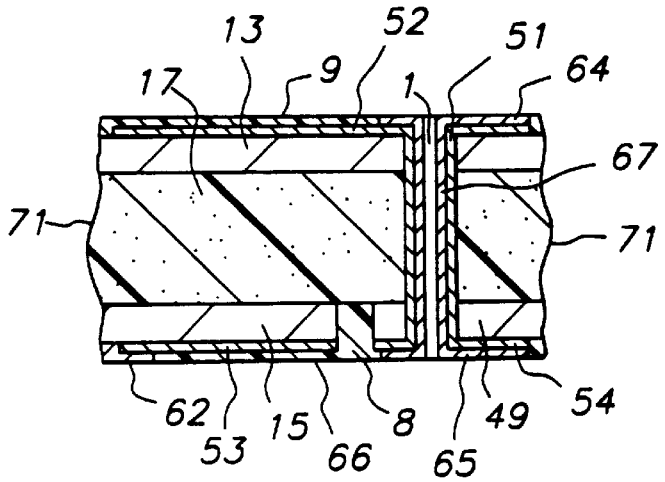

FIG. 10 shows a device obtained by snapping the assembly of FIG. 6 along the fracture channels. In FIG. 10 the device includes a laminar PTC element 17 having a first principal face to which first metal foil electrode 13 is attached, a second principal face to which second metal foil electrode 5 is attached, and four transverse fractured faces 71 (only two of which are shown in FIG. 10). Also attached to the second face of the PTC element is an additional metal foil conductive member 49 which is not electrically connected to electrode 15. Cross-conductor 51 lies within an aperture defined by first electrode 13, PTC element 17 and additional member 49. The cross-conductor is a hollow tube formed by a plating process which also results in platings 52, 53 and 54 on the surfaces of the electrode 13, the electrode 15 and the additional member 49 respectively which were exposed during the plating process. In addition, layers of solder 64, 65, 66 and 67 are present on (a) the first electrode 13 in the region of the cross-conductor 51, (b) the additional member 49, (c) the second electrode 15, and (d) the cross-conductor 51, respectively.

Figure 11:
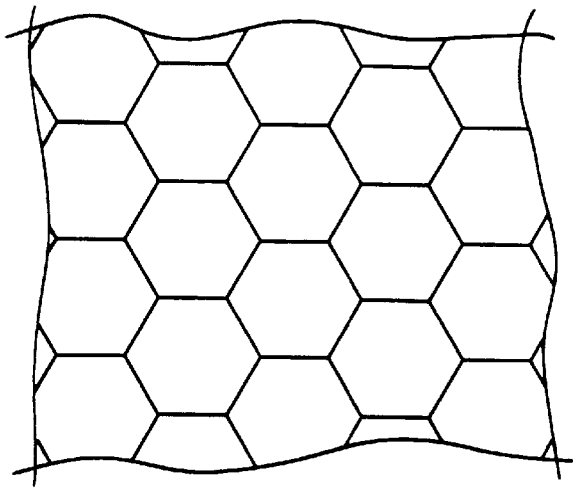
FIGS. 11–13 are diagrammatic plan views of assemblies of the invention showing different patterns of fracture channels which can be employed to make devices having different shapes.
Figure 12:
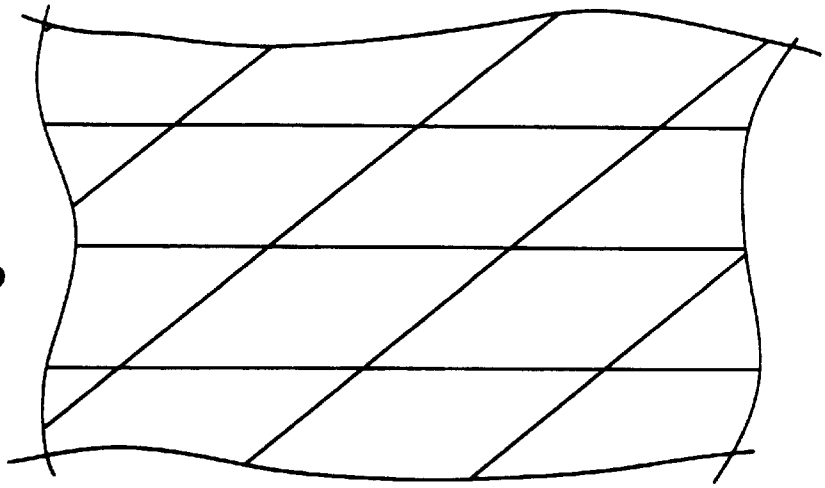
Figure 13:
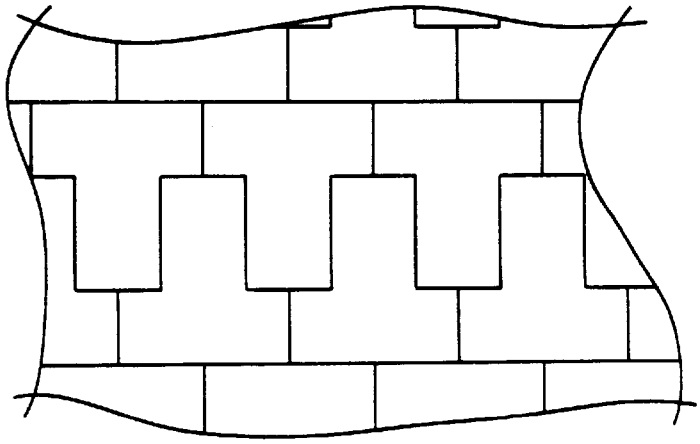

FIGS. 11–13 show other patterns of fracture channels which can be employed to produce devices having, respectively, hexagonal, rhomboid and T-shape devices.

EXAMPLE

A plaque containing a laminar PTC conductive polymer element sandwiched between two nickel foils was prepared as described in the Example of Ser. No. 08/121,717. The plaque was converted into a large number of devices by the procedure described in the Example of copending commonly assigned application filed May 16, 1994 by Zhang and Fang, except for the following differences.

(1) The photo resists used to produce masks over the plated foils exposed not only the parallel strips corresponding to the gaps between the additional conductive members and the second electrodes, but also strips about 0.004 inch wide corresponding to the edges of the devices to be produced. The etching step, therefore, produced not only the channels between the additional conductive members and the second electrodes, as in the earlier application, but also upper and lower fracture channels in the metal foils.

(2) After the masking material and the solder had been applied, the plaque was not sheared and diced into individual devices but was instead broken into individual devices by placing the plaque between two pieces of silicon rubber, placing the resulting composite on a table, and then rolling a roller over the composite first in one direction corresponding to one set of fracture channels and then in a direction at right angles to the first. The composite was then placed on the table with its other side up, and the procedure repeated. When the composite was opened up, most of the devices were completely separated from their neighbors, and the few which were not completely separated could easily be separated by hand.

What is claimed is:

1. A device which comprises (1) a laminar conductive polymer element which (a) is composed of a conductive polymer which comprises (i) a polymeric component and (ii), dispersed in the polymeric component, electrically conductive particles in an amount such that the composition has a resistivity at 23° C. of less than $10^6$ ohm-cm, and (b) has a first principal face, a second principal face parallel to the first face, and at least one transverse face which extends from the first principal face to the second principal face and consists essentially of a fractured surface;

(2) a first laminar electrode which has (i) an inner face which contacts the first principal face of the conductive polymer element, and (ii) an outer face; and (3) a second laminar electrode which has (i) an inner face which contacts the second principal face of the conductive polymer element, and (ii) an outer face.

2. A device according to claim 1 wherein each of the first and second electrodes is a metal foil.

3. A device according to claim 1 wherein the conductive polymer element has a periphery which consists of four substantially straight transverse faces at least two of which extend from the first principal face to the second principal face and consist essentially of a fractured surface.

4. A device according to claim 3 wherein each transverse face is at an angle of substantially 90° to the principal faces.

5. A device according to claim 1 wherein the conductive polymer is a PTC conductive polymer.

6. A device according to claim 5 wherein the conductive polymer element consists of a single layer of the PTC conductive polymer.

7. A device according to claim 6 wherein each of the electrodes is a metal foil and the PTC conductive polymer has a resistivity at 23° C. of less than 10 ohm-cm.

8. A method of making a device, which method comprises (1) making an assembly which comprises (A) a laminar conductive polymer element which (a) is composed of a composition which comprises a polymeric component and, dispersed in the polymeric component, electrically conductive particles in an amount such that the composition has a resistivity at 23° C. of less than $10^6$ ohm-cm, and (b) has a first principal face and a second principal face parallel to the first face;

(B) a plurality of upper laminar conductive members, each of which has (a) an inner face which contacts the first principal face of the conductive polymer element and (b) an outer face, the upper conductive members defining, with intermediate portions of the conductive polymer element, a plurality of upper fracture channels which do not penetrate into the conductive polymer element; and (C) a plurality of lower laminar conductive members, each of which has (a) an inner face which contacts the second principal face of the conductive polymer element, and (b) an outer face, the lower conductive members defining, with intermediate portions of the conductive polymer element, a plurality of lower fracture channels which do not penetrate into the conductive polymer element; and (2) separating the assembly into a plurality of devices by a process which comprises applying physical forces to the assembly which cause the conductive polymer element to fracture along a plurality of paths each of which runs between one of the upper fracture channels and one of the lower fracture channels, thus producing transverse faces which extend from the first principal face to the second principal face and consist essentially of a fractured surface.

9. A method according to claim 8 wherein said assembly has been prepared by a process which comprises (1) providing an assembly which comprises (A) said laminar conductive polymer element, (B) an upper laminar metal foil, and (C) a lower laminar metal foil; and (2) etching a plurality of lines in the upper and lower foils, thus dividing them into said upper and lower conductive members without etching the conductive polymer element.

* * * * *